US006725512B2

(12) United States Patent
Carter

(10) Patent No.: US 6,725,512 B2
(45) Date of Patent: Apr. 27, 2004

(54) IMAGED NONWOVEN FABRIC FOR CLEANING APPLICATIONS

(75) Inventor: Nick Mark Carter, Mooresville, NC (US)

(73) Assignee: Polymer Group, Inc., North Charleston, SC (US)

( * ) Notice: Subject to any disclaimer, the term of this patent is extended or adjusted under 35 U.S.C. 154(b) by 88 days.

(21) Appl. No.: 10/163,275

(22) Filed: Jun. 5, 2002

(65) Prior Publication Data

US 2003/0019088 A1 Jan. 30, 2003

Related U.S. Application Data

(60) Provisional application No. 60/296,034, filed on Jun. 5, 2001.

(51) Int. Cl.[7] ..... D04H 1/46

(52) U.S. Cl. ..... 28/104

(58) Field of Search ..... 28/104, 105, 167, 28/163, 106; 442/408; 156/148; 428/133, 166, 167, 168, 169, 170, 171, 220

(56) References Cited

U.S. PATENT DOCUMENTS 2,302,020 A * 11/1942 Frederick, Jr. ..... 28/104
3,485,706 A 12/1969 Evans
4,537,819 A * 8/1985 Schortmann et al. ..... 442/370
5,098,764 A 3/1992 Bassett et al.
5,137,600 A * 8/1992 Barnes et al. ..... 28/105
5,144,729 A * 9/1992 Austin et al. ..... 28/105
5,618,610 A * 4/1997 Tomita et al. ..... 428/152
5,670,234 A * 9/1997 Suehr et al. ..... 28/104
5,827,597 A * 10/1998 James et al. ..... 28/104
6,314,627 B1 * 11/2001 Ngai ..... 28/104
6,641,902 B1 * 11/2003 Kobayashi et al. ..... 442/408
2002/0034914 A1 * 3/2002 De Leon et al. ..... 28/104

* cited by examiner

*Primary Examiner*—A. Vanatta
(74) *Attorney, Agent, or Firm*—Wood, Phillips, Katz, Clark & Mortimer

(57) ABSTRACT

The present invention is directed to enhancing the cleaning of surfaces by the contact application of a non-apertured nonwoven fabric having a three-dimensional image imparted therein. The three-dimensional image of the non-apertured nonwoven fabric induces the formation of lather due to pronounced surface projections that come in contact with the cleaning surface and provide air passageways that are parallel to the plane of the substrate. The imaged nonwoven fabric disclosed herein exhibits low linting qualities thereby reducing the potential of fiber contamination of the cleaned surface and is sufficiently durable that the sample can be used in a brisk manner.

21 Claims, 8 Drawing Sheets

TTD thickness: 0.25"
Thickness at Drainage: 0.15"

ITD thickness: 0.25"
Thickness at Drainage: 0.15"
Aperture Forming Height: 0.08"

FFD thickness: 0.25"
Thickness at Drainage: 0.15"

ITD thickness: 0.25"
Thickness at Drainage: 0.15"
Nub Height: 0.08"

Upper Plane Thickness: 0.24"
Lower Plane Thickness: 0.14"

IMAGED NONWOVEN FABRIC FOR CLEANING APPLICATIONS

TECHNICAL BACKGROUND

The present invention is generally directed to three-dimensional imaged nonwoven fabrics and the methods for employing such three-dimensional imaged nonwoven fabrics as a means for cleaning surfaces. A particularly preferred embodiment of a three-dimensional imaged nonwoven fabric of the present invention is in facial cleansing applications.

BACKGROUND OF THE INVENTION

Over the years, the use of disposable substrates in cleaning applications has been well practiced. Suitable substrates have included sponges, woven and nonwoven fabrics, and various combinations thereof. Further, such substrates have been impregnated with cleaning agents such as astringents, solvents, detergents and other chaotropes. The resulting cleaning products fabricated from such impregnated substrates have found acceptance with the general public as a convenient and practical means for the cleaning of surfaces. In particular, such constructs have been reasonably successful in the facial cleansing market.

Substrates of particular importance in the facial cleansing market include those fabrics that are imparted with apertures, or otherwise exhibit regions devoid of substrate matrix. It is has been conjectured by the fabricators of facial cleansing products practicing the use of such apertured fabric that the presence of the apertures improve the ability of the substrate to quickly build a beneficial lather during the cleansing process.

The presence of apertures in a facial cleansing product has been found to be a difficult and complex material to fabricate due to a need to have an absolute minimum in the occurrences of occluded apertures. Occlusion of the aperture, for example by the fibrous matrix of a nonwoven substrate, has multiple deleterious affects. First, the occlusion results in an expected reduction of efficacy during a lather generation procedure due to the further constriction of the occlusion by the buildup of applied detergent agents. Second, an apertured substrate is difficult to fabricate so as to be functional and at the same time aesthetically pleasing. The very real problem of aesthetic appeal to the end-user is based on the fact that the human eye is attracted to variation in repeating patterns. An intermittent occlusion, even if only subtle in degree, will result in the user perception of a low quality product. The need for uniformity of aperture must be anticipated during the fabrication process and substrate material rejected should the aperture clarity at any time fall outside of predetermined specifications, thus leading to an exceedingly high level of potential material being rejected.

There remains a need for a disposable substrate for cleaning applications, and particularly facial cleansing products, which is capable of forming lather, and does not suffer from the deleterious affects inherent to apertured substrates.

SUMMARY OF THE INVENTION

The present invention is directed to enhancing the cleaning of surfaces by the contact application of a non-apertured nonwoven fabric having a three-dimensional image imparted therein. The three-dimensional image of the non-apertured nonwoven fabric induces the formation of lather due to pronounced surface projections that come in contact with the cleaning surface and provide air passageways that are parallel to the plane of the substrate. The imaged nonwoven fabric disclosed herein exhibits low Tinting qualities thereby reducing the potential of fiber contamination of the cleaned surface and is sufficiently durable that the sample can be used in a brisk manner.

A method of making the present durable nonwoven fabric comprises the steps of providing a precursor web that is subjected to hydroentangling. The precursor web is formed into an imaged nonwoven fabric by hydroentanglement on a three-dimensional image transfer device. The image transfer device defines three-dimensional elements against which the precursor web is forced during hydroentangling, whereby the fibrous constituents of the web are imaged by movement into regions between the three-dimensional elements of the transfer device.

In the preferred form, the precursor web is hydroentangled on a foraminous surface prior to hydroentangling on the image transfer device. This pre-entangling of the precursor web acts to integrate the fibrous components of the web, but does not impart imaging as can be achieved through the use of the three-dimensional image transfer device in subsequent steps.

It is further contemplated by the present invention that the use of a semi-durable three-dimensional imaged nonwoven fabric can be employed in facial cleansing applications, whereby three-dimensional image of the nonwoven fabric induces the formation of lather due to pronounced surface projections which come in contact with the facial skin and provide air passage ways necessary for lather propagation that are parallel to the plane of the non-apertured substrate. The imaged nonwoven fabric is further designed to facilitate optimal performance when used in the wetted state and when treated with or subject to surfactant compounds.

Other features and advantages of the present invention will become readily apparent from the following detailed description, the accompanying drawings, and the appended claims.

BRIEF DESCRIPTION OF THE DRAWINGS

The invention will be more easily understood by a detailed explanation of the invention including drawings. Accordingly, drawings which are particularly suited for explaining the invention are attached herewith; however, is should be understood that such drawings are for explanation purposes only and are not necessarily to scale. The drawings are briefly described as follows.

DETAILED DESCRIPTION

Figure 1:
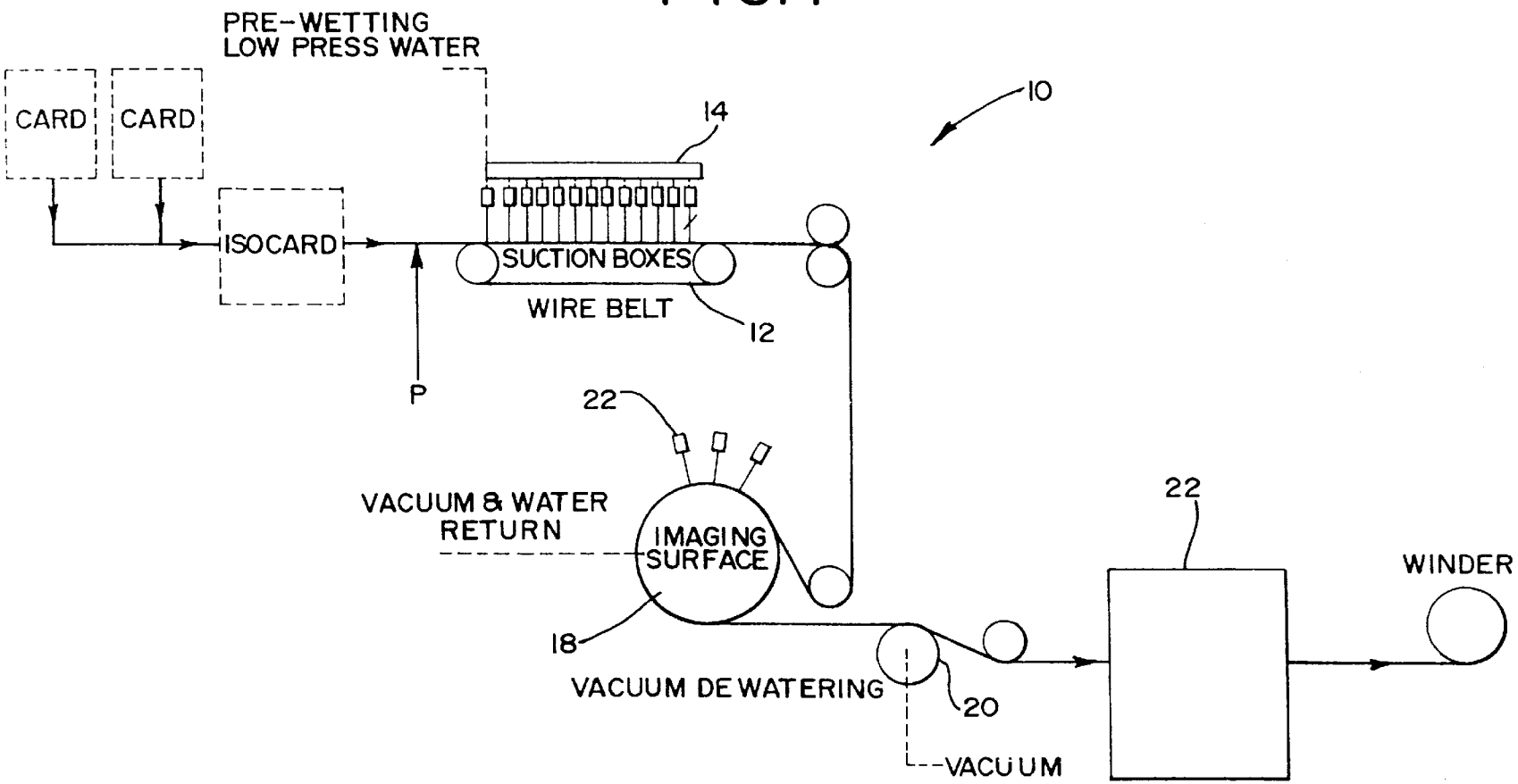
FIG. 1 is a diagrammatic view of an apparatus for manufacturing a durable three-dimensional imaged nonwoven fabric, embodying the principles of the present invention.
Figure 2:
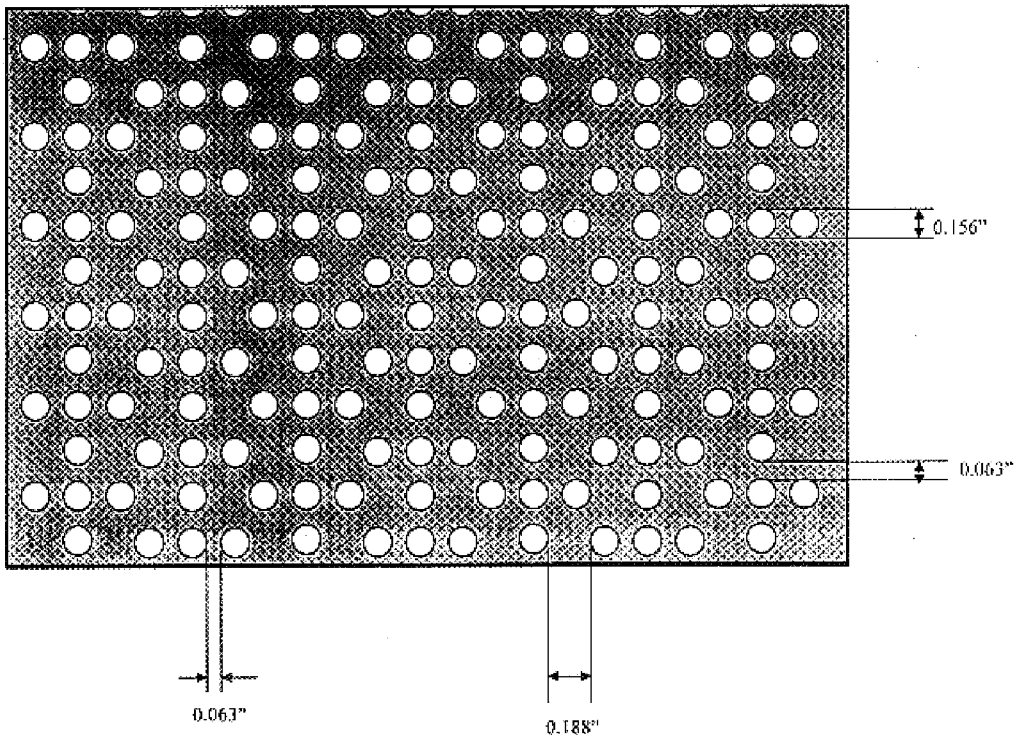
FIG. 2 is a plan view of a three-dimensional image transfer device of the type used for practicing the present invention, referred to herein as "hexagon nub"
Figure 3:
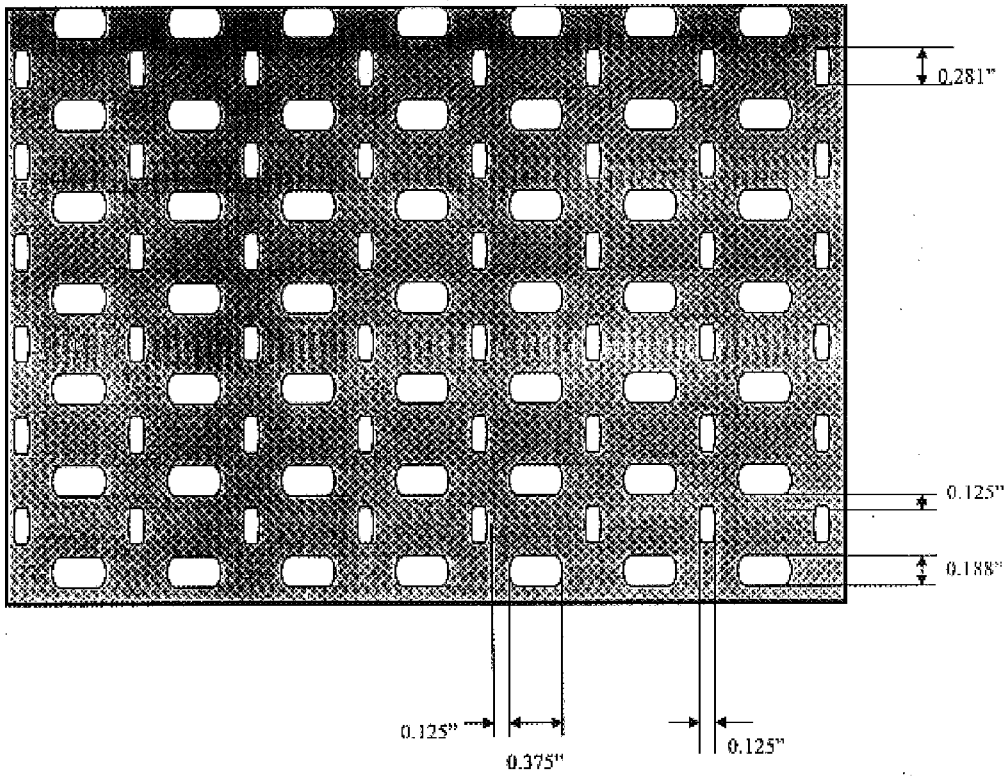
FIG. 3 is a plan view of a three-dimensional image transfer device of the type used for practicing the present invention, referred to herein as "bar nub"

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

Nonwoven fabrics are used in a wide variety of applications where the engineered qualities of the fabric can be advantageously employed. These types of fabrics differ from traditional woven or knitted fabrics in that the fabrics are produced directly from a fibrous mat, eliminating the traditional textile manufacturing processes of multi-step yarn preparation, and weaving or knitting. Entanglement of the fibers or filaments of the fabric acts to provide the fabric with a useful level of integrity. Subsequent to entanglement, fabric integrity can be further enhanced by the application of binder compositions and/or by thermal stabilization of the entangled fibrous matrix.

U.S. Pat. No. 3,485,706, to Evans, hereby incorporated by reference, discloses processes for effecting hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing a fabric with enhanced physical properties as well as having a pleasing appearance.

For application in cleaning products, a nonwoven fabric must exhibit a combination of specific physical characteristics. For example, the nonwoven fabrics used in cleansing of the face should be soft and drapeable so as to conform to the contours of the face and yet withstand brisk agitation inherent to facial cleansing procedures. Further, nonwoven fabrics used in cleaning applications must be resistant to abrasion and linting yet also exhibit sufficient strength and tear resistance.

With reference to FIG. 1, therein is illustrated an apparatus for practicing the present method for forming a nonwoven fabric. The fabric is formed from a fibrous matrix preferably comprising staple length fibers, but it is within the purview of the present invention that different types of fibers, or fiber blends, and with inclusive of an optional scrim layer, can be employed. The fibrous matrix is preferably carded and air-laid or cross-lapped to form a precursor web, designated P.

Manufacture of a nonwoven fabric embodying the principles of the present invention is initiated by providing the precursor nonwoven web preferably in the form of a blend of staple length fibers. Such fibers may be selected from natural or synthetic composition, of homogeneous or mixed fiber length. Suitable natural fibers include, but are not limited to, cotton, wood pulp and viscose rayon. Synthetic fibers, which may be blended in whole or part, include thermoplastic and thermoset polymers. Thermoplastic polymers suitable for this application include polyolefins, polyamides and polyesters. The thermoplastics may be further selected from homopolymers, copolymers, conjugates and other derivatives including those thermoplastic polymers having incorporated melt additives or surface-active agents. Staple lengths are selected in the range of 0.25 inch to 6 inches, the range of 1 to 2 inches being preferred and the fiber denier selected in the range of 1 to 15, the range of 2 to 6 denier being preferred for general applications. The profile of the fiber is not a limitation to the applicability of the present invention.

The composition of the three-dimensional imaged nonwoven fabric can be specifically chosen in light of the cleaning agent to be impregnated therein or applied thereon. For example, if a water based surfactant compound is to be applied, a hydrophilic naturally derived fiber such as rayon or a hydrophilic melt additive in a polyester staple fiber would facilitate in the imaged nonwoven fabric absorbing a controlled amount of a cleaning compound. Should it be known that an abrasive cleaning surface facing material is desirable, a polypropylene staple fiber selected from the upper denier range of staple fibers would be advised.

It is within the purview of the present invention that a scrim can be interposed in the formation of the precursor nonwoven web. The purpose of the scrim is to reduce the extensibility of the resultant three-dimensional imaged nonwoven fabric, thus reducing the possibility of three-dimensional image distortion and further enhancing fabric durability. Suitable scrims include unidirectional monofilament, bi-directional monofilament, expanded films, and thermoplastic spunbond.

It is also within the purview of the present invention that a binder material can be either incorporated as a fusible fiber in the formation of the precursor nonwoven web or as a liquid fiber adhesive applied after imaged fabric formation. The binder material will further improve the durability or otherwise provide enhanced cleaning performance of the resultant imaged nonwoven fabric during use.

Figure 6:
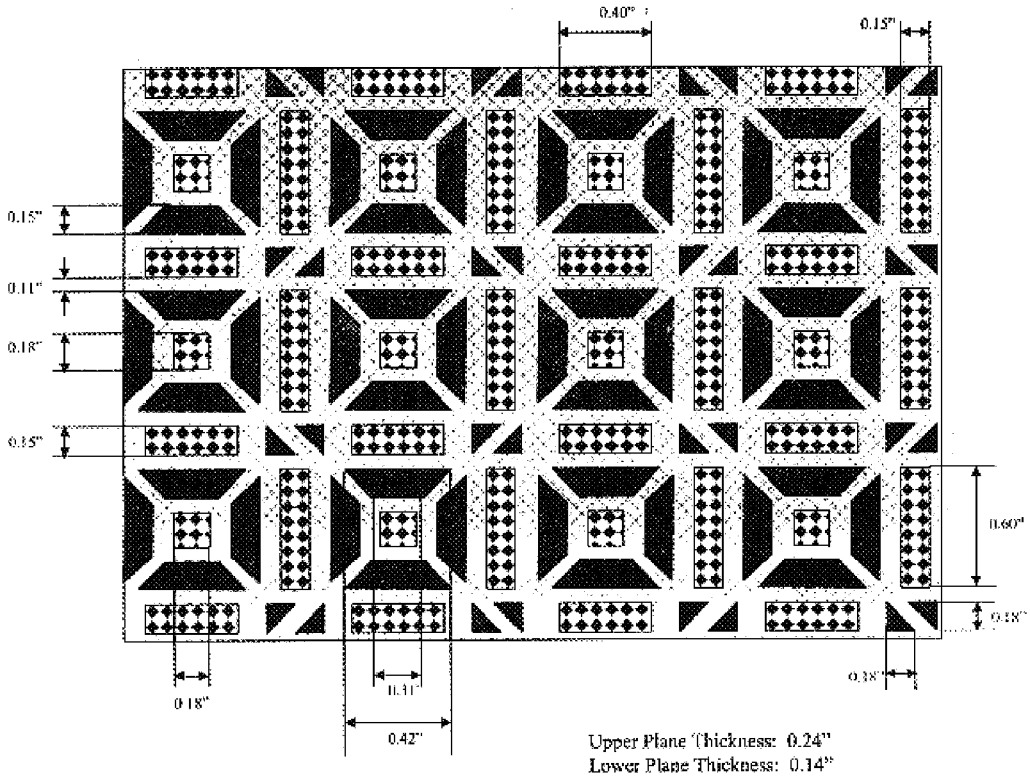
FIG. 6 is a plan view of a three-dimensional image transfer device of the type used for practicing the present invention, referred to herein as "large segmented diamond"
Figure 7:
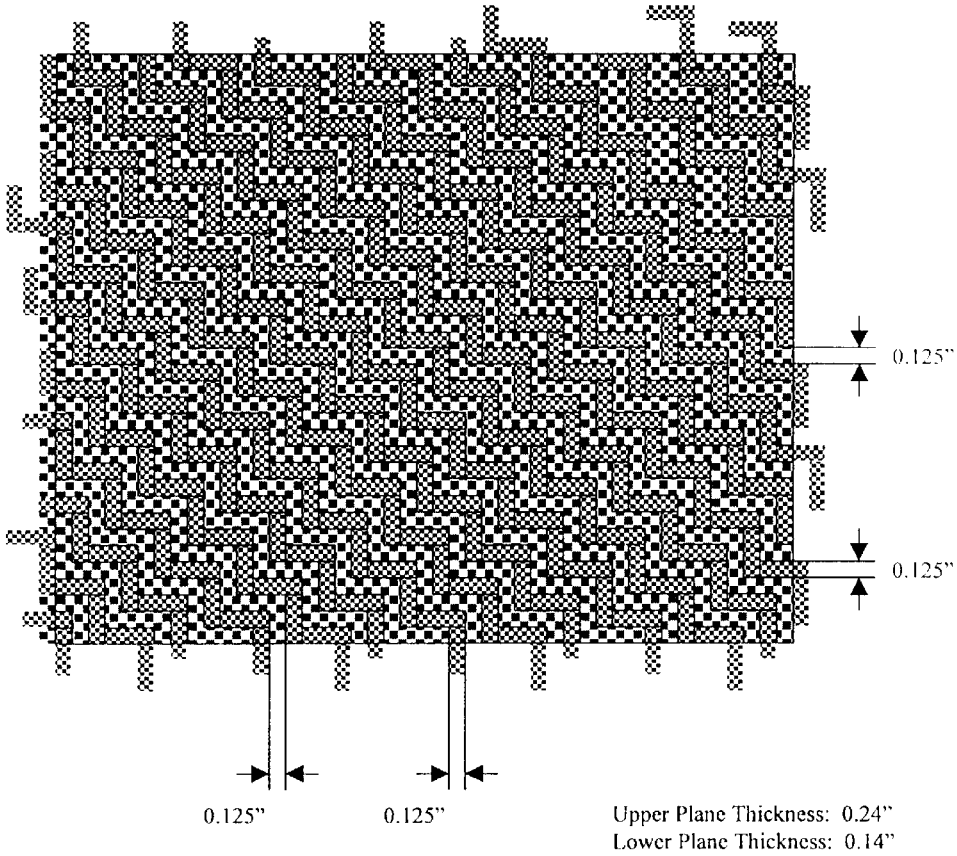
FIG. 7 is a plan view of a three-dimensional image transfer device of the type used for practicing the present invention, referred to herein as "zig-zag"
Figure 8:
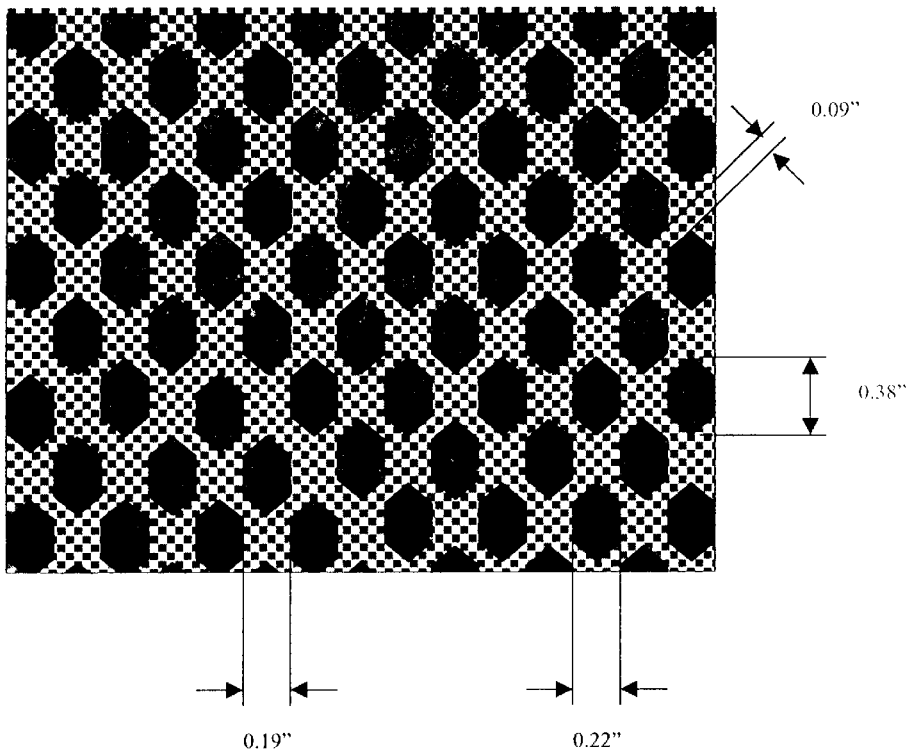
FIG. 8 is a plan view of a three-dimensional image transfer device of the type used for practicing the present invention, referred to herein as "large honeycomb"

FIG. 1 depicts the means for imparting the three-dimensional quality during the manufacture of the nonwoven fabric. The image transfer device shown as imaging drum 18 can be selected from a broad variety of three-dimensional image types. Exemplary FIGS. 2, 3, 4, and 5, are three-dimensional images of the "nub" type. Fibrous nubs are formed during the process of entangling on the imaging drum 18, these nubs extending out of the planar background of the resulting fabric. These fibrous nubs act as the high points and resulting surface contact. FIGS. 6, 7, and 8, are examples of the "geodesic" type of images. In this image type, regular blocks of entangled constituent fibers extended out of the planar background, the fibrous blocks creating high points that are particular effective at providing air passageways parallel to the substrate surface. Due to the flexibility inherent to the fabrication of the image on the image transfer device, variations in three-dimensional image including multi-planar images, variations in image juxtaposition, and the ability to create complex images having no discontinuities allow for the creation of profiles in nonwoven fabrics heretofore impossible.

It is contemplated that the air passageways defined by the surface projections, with reference to the machine direction (MD) and cross-direction (CD), comprise between about 29% and 83%, per linear inch of fabric, with the passageways each having a dimension between about 0.063 inch and 0.625 inch.

EXAMPLES

Example 1

Using a forming apparatus as illustrated in FIG. 1, a nonwoven fabric was made in accordance with the present invention by providing a precursor web comprising 100 percent by weight polyester fibers as supplied by Wellman as Type T-472 PET, 1.2 dpf by 1.5 inch staple length. The precursor fibrous batt was entangled by a series of entangling manifolds such as diagrammatically illustrated in FIG. 1. FIG. 1 illustrates a hydroentangling apparatus for forming nonwoven fabrics in accordance with the present invention. The apparatus includes a foraminous-forming surface in the form of belt 12 upon which the precursor fibrous batt P is positioned for pre-entangling by entangling manifold 14. In the present examples, each of the entangling manifolds 14 included 120-micron orifices spaced at 42.3 per inch, with the manifolds successively operated at 100, 300, and 600 pounds per square inch, with a line speed of 45 feet per minute. The precursor web was then dried using two stacks of steam drying cans at 300° F. The precursor web had a basis weight of 1.5 ounce per square yard (plus or minus 7%).

The precursor web then received a further 2.0 ounce per square yard air-laid layer of Type-472 PET fibrous batt. The precursor web with fibrous batt was further entangled by a series of entangling manifolds 14, with the manifolds successively operated at 100, 300, and 600 pounds per square inch, with a line speed of 45 feet per minute. The entangling apparatus of FIG. 1 further includes an imaging drum 18 comprising a three-dimensional image transfer device for effecting imaging of the now-entangled layered precursor web. The image transfer device includes a moveable imaging surface which moves relative to a plurality of entangling manifolds 22 which act in cooperation with three-dimensional elements defined by the imaging surface of the image transfer device to effect imaging and patterning of the fabric being formed. The entangling manifolds 22 included 120 micron orifices spaced at 42.3 per inch, with the manifolds operated at 2800 pounds per square inch each. The imaged nonwoven fabric was dried using two stacks of steam drying cans at 300° F.

The three-dimensional image transfer device of drum 24 was configured with a multiple image forming surface consisting of five different patterns, as illustrated in FIGS. 2, 3, 4, and 5.

Example 2

An imaged nonwoven fabric was fabricated by the method specified in Example 1, where in the alternative, the precursor fibrous batt was comprised of viscose rayon as supplied by Lenzing at T-8191, 1.5 dpf by 1.5 inch staple length. Final weight of the dried prebond layer before layering of PET fiber was 1.5 ounces per square yard.

Example 3

An imaged nonwoven fabric was fabricated by the method specified in Example 1, where in the alternative, the precursor fibrous batt was comprised of 2.0 ounces per square yard PET fiber.

Example 4

An imaged nonwoven fabric was fabricated by the method specified in Example 2, where in the alternative, the precursor fibrous batt was comprised of 2.0 ounces per square yard viscose rayon.

| | |
|---|---|
| Fabric Strength/Elongation | ASTM D5034 |
| Elmendorf Tear | ASTM D5734 |
| Handle-o-meter | ASTM D2923 |
| Stiffness-Cantilever Bend | ASTM D5732 |
| Fabric Weight | ASTM D3776 |

The test data in Table 1 shows that nonwoven fabrics approaching, meeting, or exceeding the various above-described benchmarks for fabric performance in general, and to commercially available products in specific, can be achieved with fabrics formed in accordance with the present invention. Fabrics having basis weights between about 1.0 ounce per square yard and 6.0 ounces per square yard are preferred, with fabrics having basis weights of between about 3.0 ounces per square yard and 4.0 ounces per square yard being most preferred. Fabrics formed in accordance with the present invention are durable and drapeable, which is suitable for cleaning applications.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

Figure 4:
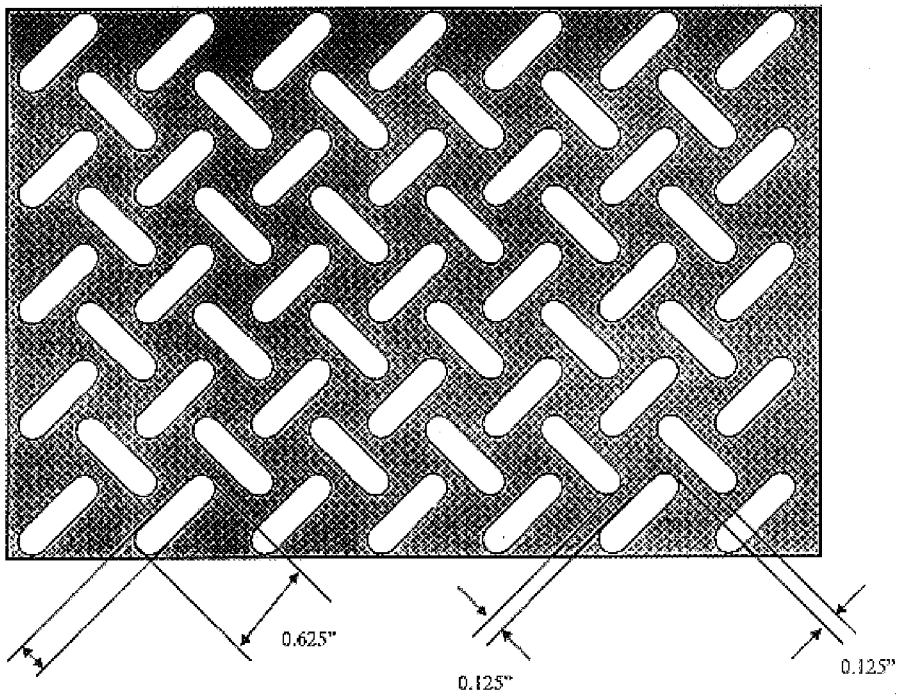
FIG. 4 is a plan view of a three-dimensional image transfer device of the type used for practicing the present invention, referred to herein as "criss-cross nub"
Figure 5:
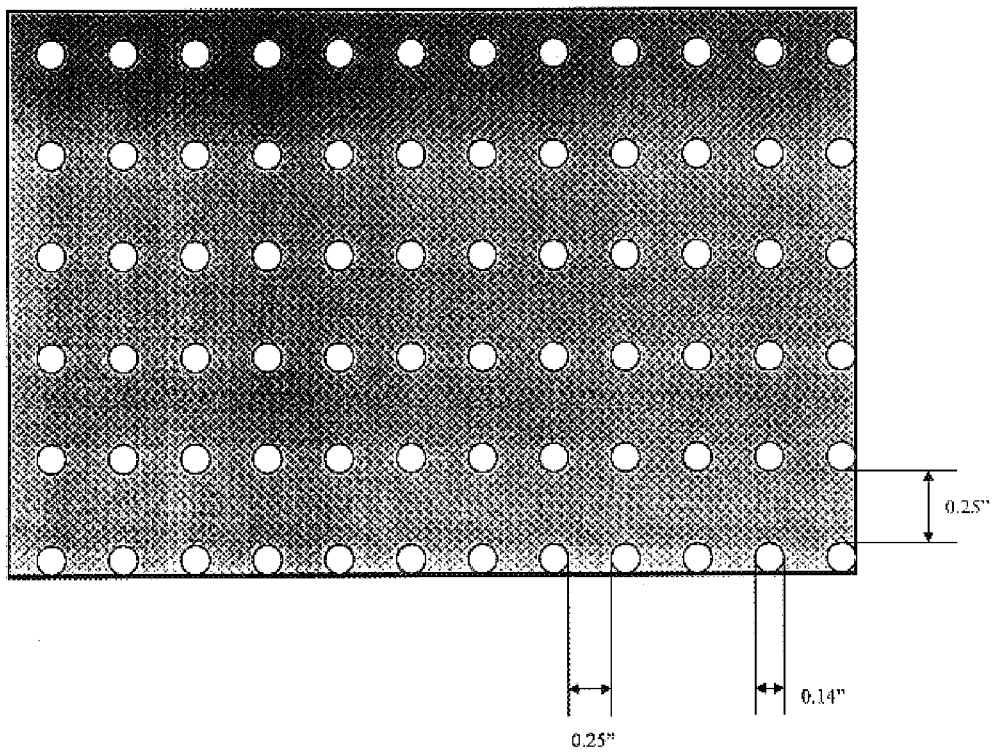
FIG. 5 is a plan view of a three-dimensional image transfer device of the type used for practicing the present invention, referred to herein as "round nub"

| Fiber Composition | Thre-Dimensional Image | Basis Weight | Bulk | Grab Tensile (MD) | Grab Tensile (CD) | Grab Elongation (MD) | Grab Elongation (CD) | Softness (MD) | Softness (CD) | Cantilever Bend (MD) | Cantilever Bend (CD) | Elmendorf Tear (MD) | Elmendorf Tear (CD) | Combined Tensile per Basis Weight | Combined Elongation per Basis Weight |
|---|---|---|---|---|---|---|---|---|---|---|---|---|---|---|---|
| Example 1 | FIG. 5 | 3.8 | 0.092 | 68.0 | 46.7 | 42.7 | 109.7 | 85 | 35 | 8.2 | 5.3 | 1458.7 | 3751.1 | 30.0 | 39.9 |
| Example 2 | FIG. 5 | 4.1 | 0.074 | 44.4 | 40.3 | 32.0 | 108.2 | 98 | 23 | 8.4 | 5.6 | 1129.8 | 3085.6 | 20.4 | 33.8 |
| Example 3 | FIG. 5 | 4.3 | 0.093 | 75.6 | 53.0 | 45.7 | 111.8 | 114 | 48 | 9.0 | 5.7 | 1547.8 | 4157.8 | 29.9 | 36.6 |
| Example 4 | FIG. 4 | 4.5 | 0.083 | 46.1 | 41.9 | 34.4 | 98.0 | 127 | 34 | 8.8 | 5.6 | 1441.0 | 2966.4 | 19.6 | 29.4 |

What is claimed is:

1. A method of forming a nonwoven fabric for cleaning applications comprising;

a) providing a precursor web;

b) providing a three-dimensional image transfer device;

c) hydroentangling said precursor web on said image transfer device to form an imaged, non-apertured nonwoven fabric having fibrous surface projections extending from a fibrous support plane; and d) said fibrous surface projections form air passageways parallel to the fibrous support plane, wherein said air passageways comprise between about 29% and 83% per linear inch of fabric, in a machine direction and a cross-direction of said fabric, and each have a dimension between about 0.063 inch and 0.625 inch.

2. The method of forming an imaged nonwoven fabric of claim 1, wherein the precursor web is comprised of staple length fibers.

3. The method of forming an imaged nonwoven fabric of claim 2, wherein the staple length fibers include surface modification agents.

4. The method of forming an imaged nonwoven fabric of claim 3, wherein the surface modification agents are selected from the group consisting of hydrophobic modifiers and hydrophilic modifiers.

5. The method of forming an imaged nonwoven fabric of claim 2, wherein the staple length fibers include the incorporation of melt additives.

6. The method of forming an imaged nonwoven fabric of claim 5, wherein the melt additives are selected from the group consisting of hydrophobic modifiers and hydrophilic modifiers.

7. The method of forming an imaged nonwoven fabric of claim 2, wherein the staple length fibers are selected from the group consisting of thermoplastic polymers, thermoset polymers, and natural fibers.

8. The method of forming an imaged nonwoven fabric of claim 7, wherein the thermoplastic polymer is a polyolefin.

9. The method of forming an imaged nonwoven fabric of claim 7, wherein the thermoplastic polymer is a polyester.

10. The method of forming an imaged nonwoven fabric of claim 7, wherein the thermoplastic polymer is a polyamide.

11. The method of forming an imaged nonwoven fabric of claim 2, wherein the staple length fibers have a denier within the range of about 0.8 to 15.

12. The method of forming an imaged nonwoven fabric of claim 7, wherein the staple length fibers have a denier within the range of 1 to 6 denier.

13. The method of forming an imaged nonwoven fabric of claim 2, wherein the staple length fibers have a staple length within the range of about 0.25 to 6 inches.

14. The method of forming an imaged nonwoven fabric of claim 13, wherein the staple length fibers have a staple length within the range of about 1 to 2 inches.

15. The method of forming an imaged nonwoven fabric of claim 1, wherein the precursor web is hydroentangled on a foraminous surface prior to said step of hydroentangling said web on said image transfer device.

16. The method of forming an imaged nonwoven fabric of claim 1, wherein the three-dimensional image transfer device is selected from the "nub" type.

17. The method of forming an imaged nonwoven fabric of claim 1, wherein the three-dimensional image transfer device is selected from the "geodesic" type.

18. The method of forming an imaged nonwoven fabric of claim 1, wherein the fabric has a basis weight within the range of about 1.0 to 6.0 ounces per square yard.

19. The method of forming an imaged nonwoven fabric of claim 18, wherein the fabric has a basis weight within the range of about 3.0 to 4.0 ounces per square yard.

20. The method of forming an imaged nonwoven fabric of claim 1, wherein the air passageways provide means for forming lather when said imaged nonwoven fabric is agitated in a surfactant-containing environment.

21. The method of forming an imaged nonwoven fabric of claim 20, wherein the imaged nonwoven fabric is a facial cleaning product.

* * * * *